US006056832A

United States Patent [19]

Lespagnol et al.

[11] Patent Number: 6,056,832

[45] Date of Patent: May 2, 2000

[54] METHOD FOR PRODUCING A STEEL SHEET OR STRIP FOR MAKING A CAN, AND STEEL SHEET OR STRIP OBTAINED BY SAID PROCESS

[75] Inventors: Michel Lespagnol, Looberghe; Jean-Francois Renard, Neuilly; P. Seurin, Thionville, all of France

[73] Assignee: Sollac, Puteaux, France

[21] Appl. No.: 08/894,557

[22] PCT Filed: Feb. 13, 1996

[86] PCT No.: PCT/FR96/00233

§ 371 Date: Oct. 3, 1997

§ 102(e) Date: Oct. 3, 1997

[87] PCT Pub. No.: WO96/26295

PCT Pub. Date: Aug. 29, 1996

[30] Foreign Application Priority Data

Feb. 24, 1995 [FR] France ..... 95 02208

[51] Int. Cl.[7] ..... C22C 38/04; C21D 8/04

[52] U.S. Cl. ..... 148/320; 148/651

[58] Field of Search ..... 148/651, 320

[56] References Cited

U.S. PATENT DOCUMENTS 5,587,027 12/1996 Tosaka et al. ..... 148/651

FOREIGN PATENT DOCUMENTS 0 164 263 12/1985 European Pat. Off. .

0 521 808 1/1993 European Pat. Off. .

0 524 162 1/1993 European Pat. Off. .

2 689 907 10/1993 European Pat. Off. .

0659 889 6/1995 European Pat. Off. .

405345924 12/1993 Japan ..... 148/651

405345925 12/1993 Japan ..... 148/651

OTHER PUBLICATIONS

Patent Abstracts of Japan, vol. 16, No. 128 (C924), Apr. 2, 1992 & JP,A,03 294432 (Nippon Steel), Dec. 25, 1991.

Patent Abstracts of Japan, vol. 14, No. 382 (C–749), Aug. 17, 1990 & JP,A,02 141536 (Nippon Steel), May 30, 1990.

*Primary Examiner*—Deborah Yee

*Attorney, Agent, or Firm*—Oblon, Spivak, McClelland, Maier & Neustadt, P.C.

[57] ABSTRACT

Process for producing a sheet or strip for making a can obtained by drawing and ironing from a steel having the following composition in percentage by weight: Carbon less than 0.008%, Manganese between 0.10 and 0.30%, Nitrogen less than 0.006%, Aluminium between 0.01 and 0.06%, Phosphorus less than 0.015%, Sulphur less than 0.020%, Silicon less than 0.020%, a maximum of 0.08% of one or more elements selected from copper, nickel and chromium, the remainder being iron and residual impurities, in which process the slab is hot rolled into a hot sheet or strip having a thickness less than 3 mm, and then the hot sheet or strip is cold rolled with a reduction of between 83 and 92% and subjected to a recrystallization annealing and cold rerolled with a reduction of between 10 and 40%.

11 Claims, No Drawings

METHOD FOR PRODUCING A STEEL SHEET OR STRIP FOR MAKING A CAN, AND STEEL SHEET OR STRIP OBTAINED BY SAID PROCESS

BACKGROUND OF THE INVENTION

1. Field of the Invention

The present invention relates to a process for producing a steel sheet or strip for making a can obtained by drawing and ironing, of the beverage can type.

The present invention also relates to a steel sheet or strip for making a can obtained by drawing and ironing.

2. Description of the Background

This type of can usually comprises a bottom, a thin peripheral wall and a neck for achieving the setting or seaming of a lid, which may be of the easily-opened type, and is produced in particular by drawing and ironing a cup cut from a metal sheet or strip.

For this purpose, the cup is subjected first of all to a drawing operation with a relatively severe reduction on a press which comprises in the conventional manner, on one hand, a fixed punch and a support forming a peripheral blank holder which is slidable around said punch and on which the cup rests, and, on the other hand, a die to be applied against the cup with a force transmitted vertically by an upper slide.

The cup, comprising a bottom and a flange formed by the drawing operation, is then either calibrated by a light drawing operation without the use of a blank holder, or redrawn with a blank holder and is then subjected to an ironing operation which comprises drawing the flange, by means of a draw die with successive reductions, so as to progressively form the thin peripheral wall of the can.

Thereafter, the bottom is formed on the draw die so as to impart thereto a given geometry and the neck of the thin peripheral wall is formed in accordance with two methods, namely a necking method with a die, named die-necking, or a necking method employing a forming roller, named spin necking The method for necking with a die comprises forcing the neck into a die having a conical inlet profile and a cylindrical outlet profile. A cylindrical element guides the formed wall as it leaves the die.

The force required to permit the deformation of the metal is derived from the thrust applied on the bottom of the can and axially transmitted by its thin peripheral wall.

To reach the desired inside diameter, a plurality of successive reductions are required, each being a distinct forming step. When the reduction in diameter is obtained, flanging is usually effected with flanging rollers.

The spin-necking method employing a forming roller comprises driving the can in rotation while it is maintained between a pusher and a centring ring.

The free end of the thin peripheral wall is engaged on a mandrel and two axially travelling rollers form the neck of the can which progressively leaves the mandrel while always being maintained between the pusher and the centring ring.

The profile of the neck is obtained by the simultaneous displacements of the rollers, the centring ring and the pusher.

Subsequent to these various operations, the can is filled and a lid, for example of the easily-opened type, is set or seamed on the neck of the can.

It is known to use for making this type of can a steel sheet or strip of extra-soft steel type the composition of which in percentage by weight is the following:

Carbon of the order of 0.030 to 0.040%
Manganese of the order of 0.15 to 0.25%
Nitrogen of the order of 0.004 to 0.006%
Aluminium of the order of 0.03 to 0.05%
Phosphorus less than 0.015%
Sulphur less than 0.020%
Silicon less than 0.020%,
a maximum of 0.08% of one or more elements selected from copper, nickel and chromium, the remainder being iron and residual impurities.

The sheet or the strip is produced by a process in which the slab issuing from a continuous casting operation is hot rolled, then cold rolled to obtain a thin sheet or foil which is subjected to a recrystallization annealing operation at a temperature below Ac1.

This process permits obtaining a thin sheet or foil which has a final thickness of about 0.30 mm, and making from this sheet a can whose thin peripheral wall has, after drawing and ironing, a thickness of the order of 0.1 mm.

Now, manufacturers of cans, for reasons of economy and increased productivity, aim at producing cans of reduced weight, i.e. with thinner walls.

In order to enable the can with thinner walls to withstand the pressure of the liquids it contains, particularly when it concerns a gaseous beverage, and in order to ensure that the can itself has a sufficient strength, steels of improved mechanical characteristics must be used.

In order to improve the mechanical characteristics, manufacturing firms have, with the use of an extra-soft steel of the aforementioned composition, subjected a slab to a hot rolling and to a cold rolling to obtain a sheet which is subjected to a recrystallization annealing at a temperature below Ac1, and is then cold rerolled.

But it is known that a reduction in the thickness or an improvement in the mechanical characteristics of sheets or strips accentuates the phenomena of creasing when making the cans.

Tests have shown that this process results in a narrowing of the range of drawability of the sheet or the strip and an increase in the earing coefficient.

A narrower drawability range results in difficulties in the forming of the bottom and is the origin of the appearance of wrinkles during the drawing operation.

In order to avoid the formation of wrinkles when drawing, the pressure exerted by the blank holder on the sheet blank may be increased, but this increase in the pressure of the blank holder creates a problem of the control of the flow of the metal during the drawing and may consequently cause the metal to fracture or tear, particularly in the region of the connection or corner radii.

Further, the increase in the earing coefficient creates a problem when removing the can from the draw punch, i.e. during the stripping operation.

Indeed, this operation is carried out by sliding a ring along the draw punch so that it can bear against the free edge of the thin peripheral wall of the can.

When the thin peripheral wall of the body of the can has large earings, the stripping ring only bears against a few points of the peripheral wall and very often there occurs a creasing of the peripheral wall during the stripping and the can must be scrapped.

In order to reduce the earing coefficient, it is known to coil up the sheet in the hot state before the cold rolling and recrystallization annealing.

But this additional operation results in drawbacks since the edges of the sheet or strip are in direct contact with the surrounding air and cool quicker than the centre part.

This natural cooling differential between the edges and the centre results in a heterogeneity of the mechanical characteristics of the sheet or strip. Moreover, the coiling up of the sheet in the hot state results in the formation of a coarse cementite.

The coarse cementite may result in the piercing of the thin peripheral wall when forming the neck and a tearing away of this metal during the drawing operation owing to hard particles in the steel.

Further, the presence of hard particles in the steel results in a premature wear of the various drawing and ironing tools.

Consequently, manufacturers are faced with serious problems which are often antinomic when they attempt to reduce the thickness of the walls of the cans.

SUMMARY OF THE INVENTION

An object of the invention is to avoid these drawbacks by providing a process for producing a sheet or strip for making a can obtained by drawing and ironing which permits reducing the thickness of the walls of the can and consequently achieving a saving in weight.

The invention provides a process for producing a sheet or strip for making a can obtained by drawing and ironing, of the beverage can type, from a steel having the following composition in percentage by weight:

Carbon less than 0.008%

Manganese between 0.10 and 0.30%

Nitrogen less than 0.006%

Aluminium between 0.01 and 0.06%

Phosphorus less than 0.015%

Sulphur less than 0.020%

Silicon less than 0.020% a maximum of 0.08% of one or more of the elements selected from copper, nickel and chromium, the remainder being iron and residual impurities, in which process the slab is hot rolled into a hot sheet or band having a thickness of less than 3 mm, then the hot sheet or the band is cold rolled with a reduction of between 83 and 92% and subjected to a recrystallization annealing at a temperature lower than Ac1 and finally cold rerolled with a reduction of between 10 and 40%.

The invention also provides a steel sheet or strip for making a can obtained by drawing and ironing, of the beverage can type, characterized in that it is obtained by the aforementioned process.

DETAILED DESCRIPTION OF THE INVENTION

A better understanding of the invention will be had from the following description given solely by way of example.

The manufacturer of a can, of the beverage can type, by drawing and ironing comprises cutting a blank from a steel sheet or strip, then drawing this blank with a relatively severe reduction to form a cup.

Thereafter, the cup comprising a bottom and a flange is calibrated and subjected to an ironing comprising drawing the flange with successive reductions to form progressively the peripheral wall of the can.

The bottom is then formed so as to impart thereto the given geometry and the neck of the thin peripheral wall is formed either by a necking method with a die, the die necking method, or by a necking method employing a forming roller, the spin-necking method.

In order to be able to manufacture a can having very thin walls, the invention proposes producing this type of can by said drawing and ironing operation from a very low carbon steel having the following composition in percentage by weight:

Carbon less than 0.008%

Manganese between 0.10 and 0.30%

Nitrogen less than 0.006%

Aluminium between 0.01 and 0.06%

Phosphorus less than 0.015%

Sulphur less than 0.020%

Silicon less than 0.020% a maximum of 0.08% of one or more of the elements selected from the copper, nickel and chromium, the remainder being iron and residual impurities, in which process the slab is hot rolled into a hot sheet or strip having a thickness of less than 3 mm, then the hot sheet or strip is cold rolled with a reduction of between 83 and 92% and subjected to a recrystallization annealing at a temperature below Ac1 and finally cold rerolled with a reduction of between 10 and 40%.

The slab is hot rolled into a sheet having a thickness of between 1.8 and 2.5 mm and preferably between 2 and 2.4 mm, then the sheet is cold rolled with such reduction as to bring the sheet to a thickness of between 0.26 and 0.32 mm and subjected to a recrystallization annealing at a temperature below Ac1 and lastly cold rerolled with a reduction of between 28 and 35% to bring the sheet to a thickness of between 0.18 and 0.22 mm.

The recrystallization annealing is a continuous annealing.

In order to be able to produce a thin steel sheet or strip having a thickness between 0.18 and 0.22 mm and having all the characteristics required for making cans, namely drawn and ironed cans the walls of which have a thickness equal to and even less than 0.07 mm, it was realized that it is necessary to use a very low carbon steel having a carbon content lower, in percentage by weight, than 0.008% and to produce this steel in accordance with the double reduction method, i.e. to subject the hot rolled sheet or strip to a cold rolling followed by a recrystallization annealing and a cold rerolling.

Surprisingly, it was realized that to achieve the optimum mechanical characteristics to permit carrying out the drawing and ironing necessary to obtain a can whose walls have a thickness equal to 0.07 mm, the reduction produced by the first cold rolling of the sheet or strip had to be reduced.

Indeed, for example if there is examined the earing coefficient of a steel sheet or strip which was produced from a steel having the following composition in percentage by weight:

Carbon 0.003%

Manganese 0.204%

Phosphorus 0.009%

Sulphur 0.009%

Nitrogen 0.003%

Silicon 0.002%

Copper 0.008%

Nickel 0.021%

Chromium 0.017%

Aluminium 0.027% the remainder being iron, and which was hot rolled to obtain a hot rolled strip 2.3 mm thick, then cold rolled to obtain a strip 0.26 mm thick, and continously annealed at a temperature below Ac1 and finally cold rerolled to bring this strip to a thickness of 0.18 mm, the earing coefficient is equal to −0.2.

On the other hand, a sheet or strip which was produced from the same steel but hot rolled to bring it to a thickness of 1.8 mm then cold rolled to obtain a strip 0.26 mm thick, then continuously annealed under the same conditions and cold rerolled to bring it to a thickness of 0.18 mm, has a earing rate equal to −0.05, which is a coefficient very close to 0 and therefore represents a steel having a very low tendency to form earings.

It is therefore particularly important to conform to the rates of cold rolling and rerolling after annealing and to apply a high hot rolling rate so as to produce a hot rolled strip having a thickness of less than 3 mm and preferably between 1.8 and 2.5 mm.

Apart from this aspect concerning the process for obtaining the strip, it is also necessary to use a steel having a very low carbon content to be able to produce very thin, drawn and ironed cans.

In the following table 1, different steel compositions are indicated, the steels A to F being very low carbon steels, i.e. steels having a carbon percentage lower than 0.006%, and the steels G and H extra-mild steels.

This table shows that the steels G and H, although they satisfy the rolling conditions of the process according to the invention, have a coefficient ΔC further from 0 than the steels B, C, E.

Indeed, the steel B and the steel H were subjected to similar hot rolling, cold rolling, annealing and cold rerolling conditions. However, the steel H has higher yield strength and ultimate tensile strength values and above all a very much lower ΔC which is much further from 0.

Likewise, although the steel G was subjected to a cold rolling rate of 86% and a rerolling rate of 11% which are lower than those to which steel C was subjected, the ΔC of steel G is further from 0 than the ΔC of steel C.

Further, with the cold rolling rate of steel B at 85% and that of steel D at 90.7% and as these two steels were subjected to the same rerolling after annealing, the ΔC aniso of steel D is 0.24 and the ΔC aniso of steel B is −0.06.

Therefore, the steel sheet or strip of very low carbon content lower than 0.008% produced by the process according to the invention, i.e. with a hot rolling, a cold rolling with a reduction of between 83 and 92%, then a recrystallization annealing at a temperature below Ac1 and finally a cold rerolling with a reduction of between 10 and 40%, has a yield strength in the direction of the length of between 350 and 450 MPa for a final thickness of about 0.22 mm, between 440 and 540 MPa for a final thickness of about 0.20 mm and between 500 and 600 MPa for a final thickness of about 0.18 mm.

TABLE 1

| STEELS | C | Mn | P | S | N | Si | Cu | Ni | Cr | Al |
|---|---|---|---|---|---|---|---|---|---|---|
| A | 0.0032 | 0.192 | 0.008 | 0.010 | 0.003 | 0.007 | 0.007 | 0.019 | 0.015 | 0.048 |
| B | 0.0029 | 0.192 | 0.008 | 0.011 | 0.005 | 0.007 | 0.007 | 0.019 | 0.015 | 0.047 |
| C | 0.0028 | 0.192 | 0.009 | 0.011 | 0.004 | 0.007 | 0.007 | 0.019 | 0.015 | 0.048 |
| D | 0.0027 | 0.192 | 0.009 | 0.012 | 0.003 | 0.007 | 0.007 | 0.019 | 0.015 | 0.047 |
| E | 0.0033 | 0.198 | 0.012 | 0.009 | 0.002 | 0.003 | 0.006 | 0.018 | 0.018 | 0.030 |
| F | 0.0030 | 0.204 | 0.009 | 0.009 | 0.003 | 0.002 | 0.008 | 0.021 | 0.017 | 0.027 |
| G | 0.0274 | 0.192 | 0.009 | 0.011 | 0.004 | 0.007 | 0.007 | 0.019 | 0.015 | 0.048 |
| H | 0.0282 | 0.192 | 0.009 | 0.012 | 0.003 | 0.007 | 0.007 | 0.019 | 0.015 | 0.047 |

Slabs each having one of the compositions indicated in the foregoing table 1, were subjected to a treatment comprising hot rolling each slab into a sheet then cold rolling this sheet and subjecting it to a recrystallization annealing at a temperature below Ac1, and finally a cold rerolling.

The steel sheets or strips obtained by this process were subjected to tests in order to determine the yield strengths Y.S and the ultimate tensile strengths U.T.S in the direction of the length and in the transverse direction, and the earing coefficient ΔC.

The results are indicated in the following table 2.

The sheets or strips according to the invention may also be characterized by the fact that the number of grains of ferrite per $mm^2$ is between 10000 and 30000 and preferably between 15000 and 25000, which corresponds to a very small grain size.

This is important for the regularity of the characteristics of the metal throughout the length of the coil, and for

TABLE 2

| ACIERS | Cold rolling rate (reduction) | Cold rerolling rate (reduction) | Tension (length) Y.S (MPA) | Tension (length) U.T.S (MPA) | Tension (width) Y.S (MPA) | Tension (width) U.T.S (MPA) | ΔC aniso |
|---|---|---|---|---|---|---|---|
| A | 88.7% | 31% | | 595 | | 625 | −0.20 |
| B | 85% | 21% | 509 | 512 | 462 | 554 | −0.06 |
| C | 88% | 16% | 457 | 475 | 467 | 503 | −0.04 |
| D | 90.7% | 21% | 513 | 517 | | 555 | −0.24 |
| E | 90.4% | 16% | 463 | 475 | 487 | 506 | −0.13 |
| F | 91.1% | 10% | 384 | 400 | 458 | 418 | −0.11 |
| G | 86% | 11% | 455 | 477 | 360 | 501 | −0.28 |
| H | 84.3% | 20% | 532 | 551 | 350 | 584 | −0.41 |

avoiding the antinomic drawbacks with regard to the drawing, the ironing and the forming of the neck.

The process for producing a sheet according to the invention also permits retaining a given quantity of carbon in solution in the sheet.

Such a sheet therefore has the characteristic of hardening in a significant manner when stoving the varnish carried out on the can after it has been put into shape.

This characteristic is very important in the case of the manufacture of cans obtained by drawing and ironing since the sheet according to the process of the invention has adequate mechanical characteristics for facilitating the forming of the can, the mechanical characteristics varying little with respect to time.

Once the can has been formed, varnished and subjected to the stoving of the varnish, the mechanical characteristics are significantly improved, which has the advantage of increasing the strength of the can.

This strength of the can is in particular characterized by the pressure for inverting the dome of the bottom of the can.

This inverting pressure, which is the limit pressure beyond which the dome produced on the bottom of the can is inverted, increases by about 10% after stoving and changes for example from 6.3 to 6.9 bars for a given type of can.

This is particularly the case for the cold rerolling rate, after annealing the sheet, of between 10 and 30%.

In this way, the process according to the invention for producing a steel sheet or strip having a very low carbon content for making a can, of the beverage can type, obtained by drawing and ironing, permits reducing the thickness of the walls of the can and achieving a saving in weight of about 30% on the sheet or strip, while widening the range of drawability and reducing the earing coefficient and the risk of the formation of wrinkles when drawing the can.

What is claimed is:

1. Process for producing a sheet or strip for making a can obtained by drawing and ironing, from steel having the following composition in percentage by weight;

Carbon less than 0.008%

Manganese between 0.10 and 0.30%

Nitrogen less than 0.006%

Aluminum between 0.01 and 0.06%

Phosphorus less than 0.015%

Sulphur less than 0.020%

Silicon less than 0.020% a maximum of 0.08% of one or more of the elements selected from copper, nickel and chromium, the remainder being iron and residual impurities, provided that the steel contains at least 0.0015% of C. which process comprises hot rolling a slab into a hot sheet or strip having a thickness between 1.8 and 2.5 mm, cold rolling the hot sheet or the strip with a reduction to bring the sheet to a thickness between 0.26 and 0.32 mm, subjecting the sheet to a recrystallization annealing at a temperature lower than Ac1 and cold re-rolling with a reduction of between 10 and 40%.

2. Process according to claim 1, wherein the slab is hot rolled into a strip having a thickness of between 2 and 2.4 mm.

3. Process according to claim 1, wherein the strip is cold rerolled with a reduction of between 28 and 35%.

4. Process according to claims 1, wherein the strip is cold rerolled with such reduction as to bring said strip to a thickness of between 0.18 and 0.22 mm.

5. Process according to claim 1, wherein the recrystallization annealing is a continuous annealing.

6. Steel sheet or strip for making a can obtained by drawing and ironing, characterized in that it is obtained by the process according to claim 1.

7. Steel sheet or strip according to claim 6, having a yield strength in the direction of the length between 350 and 450 MPa for a sheet or strip having a final thickness of about 0.22 mm, between 440 and 540 MPa for a sheet or strip having a final thickness of about 0.20 mm, and between 500 and 600 MPa for a sheet or strip having a final thickness of about 0.18 mm.

8. Steel sheet or strip according to claim 6, wherein the number of grains of ferrite per $mm^2$ is between 10,000 and 30,000.

9. A method of making a beverage can comprising drawing and ironing the steel sheet or strip of claim 6.

10. Steel sheet or strip according to claim 6, wherein the number of grains of ferrite per $mm^2$ is between 15,000 and 25,000.

11. A process according to claim 1 wherein the carbon content is at least 0.0027 wt. %.

* * * * *